United States Patent [19]

Blondel

[11] Patent Number: 4,650,180

[45] Date of Patent: Mar. 17, 1987

[54] SPORTS GROUND, IN PARTICULAR TENNIS COURT OR MINI COURT FORMED BY USING REMOVABLE PANELS

[76] Inventor: Hubert Blondel, 1 rue Marmontel, F-75015 Paris, France

[21] Appl. No.: 671,367

[22] Filed: Nov. 14, 1984

[30] Foreign Application Priority Data

Nov. 14, 1983 [FR] France ..... 83 18000

[51] Int. Cl.[4] ..... A63J 3/00

[52] U.S. Cl. ..... 272/3; 52/481

[58] Field of Search ..... 272/3, 4, 5; 404/18, 404/29, 34, 37, 38, 40, 43; 52/408, 480, 370, 479, 481

[56] References Cited

U.S. PATENT DOCUMENTS

| | | | |
|---|---|---|---|
| 1,522,708 | 1/1925 | Andrews | 52/481 |
| 2,467,558 | 4/1949 | Kapnek | 52/370 X |
| 3,745,729 | 7/1973 | Vaughn et al. | 272/3 X |
| 4,325,546 | 4/1982 | McMahon et al. | 272/3 |

FOREIGN PATENT DOCUMENTS

| | | | |
|---|---|---|---|
| 2023630 | 11/1971 | Fed. Rep. of Germany | 272/3 |
| 2299460 | 8/1976 | France | 272/3 |
| 2467914 | 5/1981 | France | 273/29 R |
| 2494740 | 5/1982 | France | 272/3 |
| 2499606 | 8/1982 | France | 272/3 |
| 1263731 | 3/1972 | United Kingdom | 272/3 |
| 1478850 | 7/1977 | United Kingdom | 272/3 |
| 596256 | 3/1978 | U.S.S.R. | 272/3 |

*Primary Examiner*—Robert A. Hafer
*Assistant Examiner*—Arnold W. Kramer
*Attorney, Agent, or Firm*—William A. Drucker

[57] ABSTRACT

A sports ground, in particular a tennis court or mini court, is provided using removable panels which are each laid on an isolating plate, and the plates themselves rest on the previously levelled ground through a textile sheet. Connection between the panels is provided by channel sections whose upper horizontal part is fixed to the underface of the facing edges of the panels to be assembled and is extended by vertical flanges. A space is provided between the panels and is extended through openings in the horizontal part of the channel sections for allowing removal of rain water.

8 Claims, 5 Drawing Figures

SPORTS GROUND, IN PARTICULAR TENNIS COURT OR MINI COURT FORMED BY USING REMOVABLE PANELS

The present invention relates to a sports ground, particularly a tennis court or mini court, of a removable and transportable type able to be readily installed, temporarily or permanently, on any horizontal surface.

For this, the sports ground, in particular a tennis court or mini court, is formed from a set of panels assembled together by means of connecting elements, this assembly of panels being laid on a horizontal surface or on the natural ground. The removable assembly thus formed may be installed for example, during the summer season, on football grounds and mountain skating rinks which are then unused and, during the winter season, on lawn tennis courts or more generally on any other temporarily or permanently available ground.

Research effected by the inventor had led him to propose, in his French certificate of utility no. 81. 02685, assembling the panels forming the ground by using rigid plates, made preferably from metal, disposed under the joints between the panels and fixed thereto. However, experience has shown that such an arrangement is not entirely satisfactory for deformation of the panels occurs, due in particular to the appreciable difference in temperature and/or hygrometry existing between the two faces of each panel, which the connecting plates cannot prevent.

The present invention therefore proposes a different method of arranging the panels and of assembling them together which overcomes the disadvantages of known devices, avoiding in particular any deformation of the panels, ensuring reliable assembly thereof, providing a playing surface having appreciable flexibility and preventing the level of any standing water reaching the level of the panels.

To this end, in accordance with the invention, each panel rests on the previously levelled ground through an isolating plate made from any suitable material such for example as polystyrene or polyurethane, and the assembly of the panels together is obtained by connecting elements, made preferably from metal, each having a horizontal part fixed to the underface of two adjacent panels and vertical parts bearing on the ground.

It will be readily understood that the plates made from an isolating material disposed under the panels have a fourfold role:

(a) they provide in height the passage of the vertical parts of the connecting elements fixed to the panels.

(b) they isolate the lower face of the panels from the ground and thus avoid it being subjected to considerable differences in temperature or hygrometry with respect to the face exposed to the atmosphere while partially neutralizing the tendancy of the panels to be deformed.

(c) they maintain the panels, at a distance from the ground (of the order of 20 mm) such that, in normal cases of installation, they place them appreciably above the level of the water or pools of water which may form after rain.

(d) they give flexibility to the playing surface and thus provide comfort and safety for users while avoiding the risks of articular fatigue.

The connecting elements used play a double role:

(a) they form stiffening elements opposing the forces tending to deform the panels which may exist despite the use of isolating plates.

(b) they join the panels together width wise or length wise.

Advantageously, a textile sheet may be disposed between the isolating plates and the ground which is permeable to water but impermeable to the elements forming the ground, which will allow rain water to soak into the ground while preventing the constituent elements of the soil from rising.

It will be further noted that the panels used in accordance with the invention may be advantageously formed from weather proof materials for external use on the ground. The panels may be formed more especially by special plywood panels possibly coated with an impermeable and non slip surface product.

According to a preferred embodiment of the invention each connecting element is in the form of a channel section in the horizontal upper part of which are formed holes for fixing it, for example by bolting, to the opposite edges of the under faces of two adjacent panels to be assembled together. According to a variant, the vertical parts may have at their upper end a horizontal inwardly directed flange giving the section an omega profile.

Advantageously, the edges of adjacent panels, in the assembled position, are spaced apart by a small distance and, in the free space thus formed, the horizontal face of the connecting element has openings for allowing the rain water to flow to the periphery of each of the panels.

In another embodiment, each connecting element is formed by two angle irons whose horizontal flanges are fixed to the underface of the opposite edges of two adjacent panels and whose vertical facing panels are secured together for example by welding or bolting. The edges of the adjacent panels as well as the vertical assembly flanges of the angle irons fixed to these panels are spaced apart by a small distance for allowing removal of rain water.

Finally, according to an additional characteristic of the invention, more rapid discharge of rain water may be obtained by slightly bending the panels so as to obtain on each panel a slope directing the water from the center of the panel towards the periphery thereof, i.e. towards the ground.

For a better understanding of the device of the invention, two preferred embodiments thereof will be described hereafter with reference to the enclosed schematic drawings in which.

Figure 1:
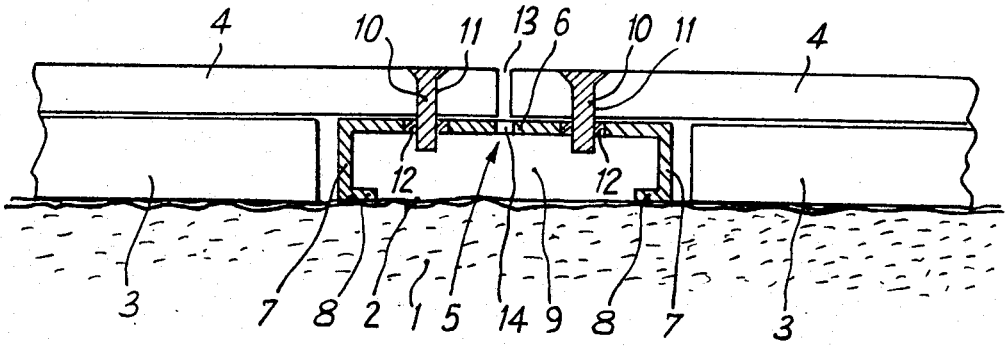
FIG. 1 is a vertical sectional view showing the assembly of two adjacent panels by means of a first embodiment of the omega profile connecting element.
Figure 2:
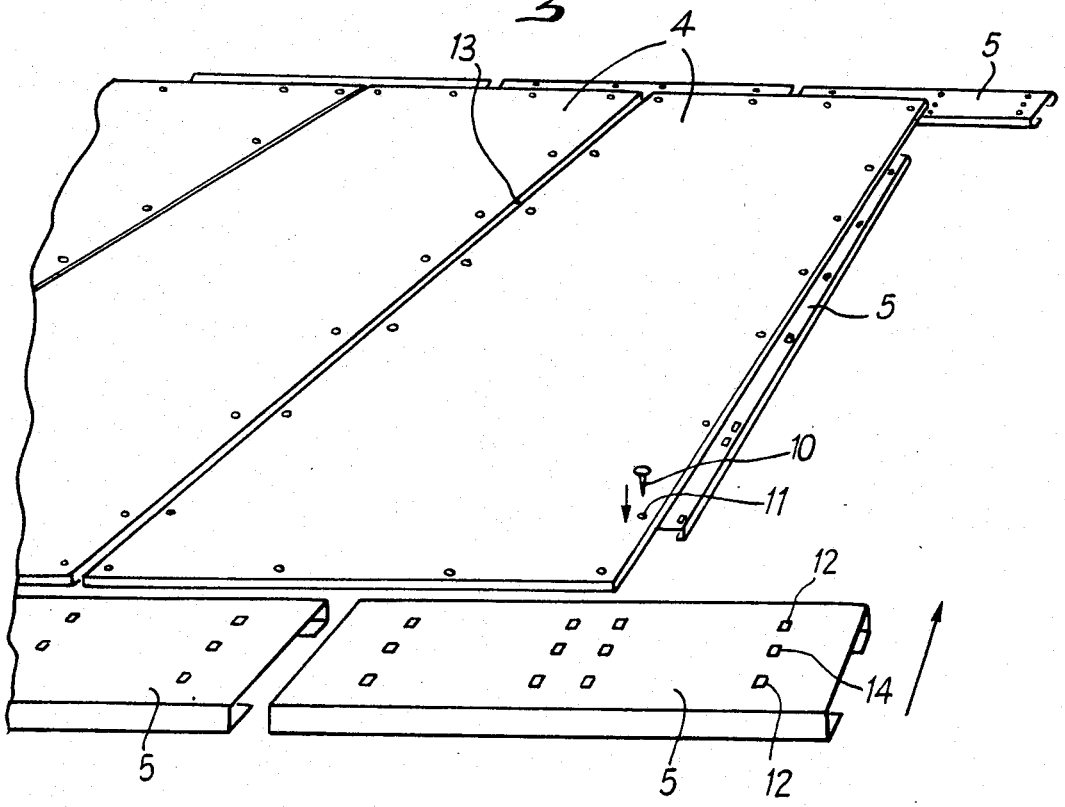
FIG. 2 is a perspective view, showing the assembly of panels by means of connecting elements according to FIG. 1, oriented longitudinally and transversely.

Referring to FIGS. 1 and 2, at 1 can be seen the natural soil previously levelled and possibly slightly compacted. The ground may be advantageously levelled by using fine sand, coarse sand or any other suitable material. On ground 1 is disposed a textile sheet 2 forming an isolating layer permeable to water but impermeable to the elements forming the ground and thus preventing these elements from rising. On textile 2 are placed, spaced slightly apart from each other, isolating plates 3 made from polystyrene, polyurethane or from a similar material, of a thickness of the order of about 20 mm. On each isolating plate 3 is laid (and possibly fixed) a panel 4 formed from a weather proof material for use on the outside court. Panel 4 may be more particularly formed from a special plywood panel possibly coated with a product giving an impermeable and non slip surface.

Connection between panels 4 is provided by connecting elements 5 each formed by a metal section having an upper horizontal part 6 continued on each side by a vertical part 7 having at its lower end a horizontal inwardly turned flange 8, so that the connecting element 5 has an omega profile.

The connecting element 5 is disposed below the adjacent edges of two panels 4, in the space 9 left free by the isolating plates 3.

The upper face 6 is then fixed to the underface of the adjacent panels 4 by screws 10 passing through openings 11 in panels 4 and holes 12 with incorporated nut formed in the upper face 6 of element 5. Such fastening could however be provided by any other appropriate means, for example by means of clips.

In the assembled position of panels 4, the adjacent edges thereof are spaced apart by a small distance 13 (for example of the order of 5 mm) in the extension of which the upper face 6 of element 5 has openings 14 allowing rain water to flow towards the ground.

As can be seen in FIG. 2, the connecting elements 5, besides their assembly role, also play the role of stiffeners by opposing the forces tending to deform panels 4 which may exist despite the use of isolating plates 3. Disposed longitudinally and transversely, connecting elements 5 prevent the deformation of panels 4 widthwise and lengthwise.

Figure 3:
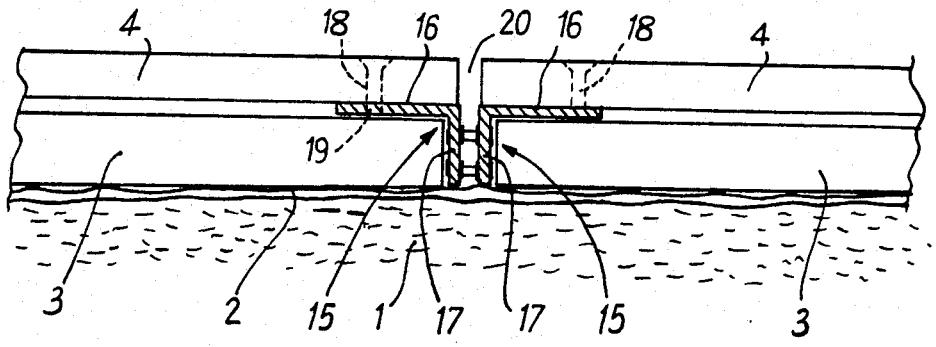
FIG. 3 is a vertical sectional view showing the assembly of two adjacent panels by using a connecting element in accordance with a second embodiment of the invention.
Figure 4:
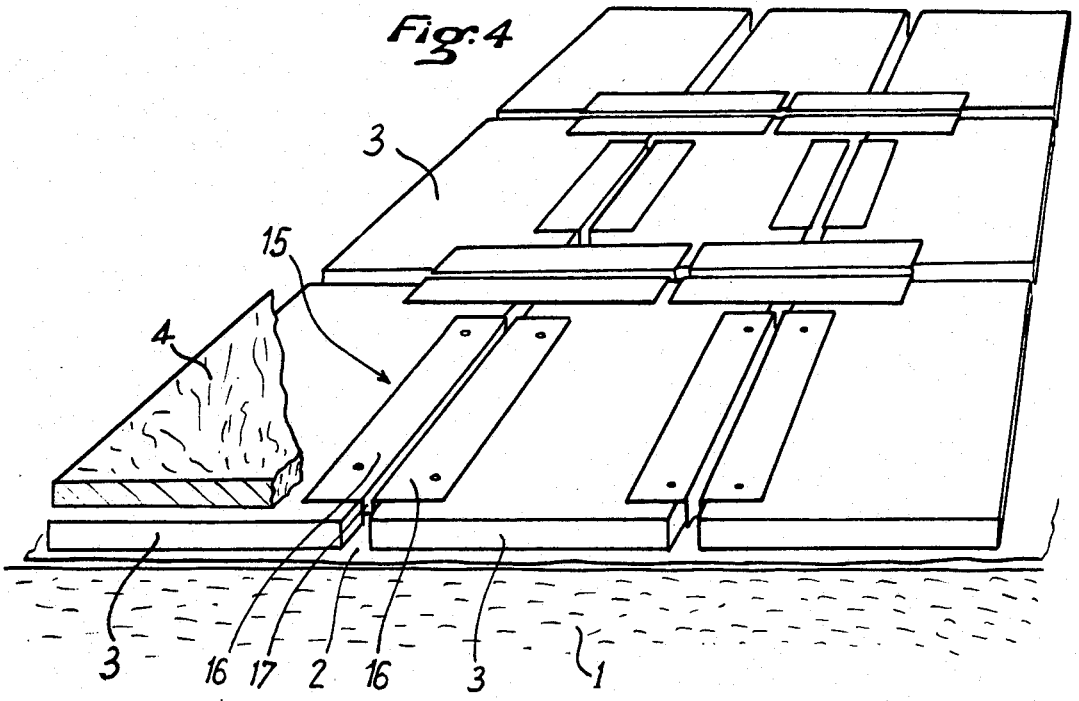
FIG. 4 is a perspective view showing the provision of longitudinal and transverse connections between panels using connecting elements such as shown in FIG. 3.

In FIGS. 3 and 4 can be seen the natural ground 1, the water permeable textile sheet 2, the isolating plates 3, and panels 4. Connection between panels 4 is provided by metal angle irons 15, the upper face of the horizontal flange 16 of the angle iron 15 being fixed to the lower face of panel 4 whereas the downwardly turned vertical flange 17 of the angle iron is intended to be secured, by bolting in the example shown, to the opposite vertical flange 17 of the angle iron 15 fixed to the adjacent panel 4. The horizontal flange of angle iron 15 can be fixed to the lower face of panel 4, for example, by using screws 18 cooperating with nuts 19 prefixed in the angle iron, but they could be fixed together by any other appropriate means using clips or other systems.

Angle irons 15, which also play the role of stiffeners, are disposed longitudinally and transversely, as can be seen in FIG. 4, preventing the widthwise and lengthwise deformation of panels 4. It will be readily understood that, for a better understanding of this Figure, parts of panel 4 have been cut away and that in actual fact each isolating plate 3 supports a panel 4 to which the angle irons 15 are fixed.

As can be seen in particular in FIG. 3, a small space 20 (for example of the order of 5 mm) is provided between panels 4 and a space of the same order of size is formed between the vertical flanges of angle irons 15 so as to allow rain water to flow through the construction then through the permeable textile 2.

For facilitating this rain water flow, it is possible to give the platform formed by ground 1 a slight slope (of the order of 1%).

Figure 5:
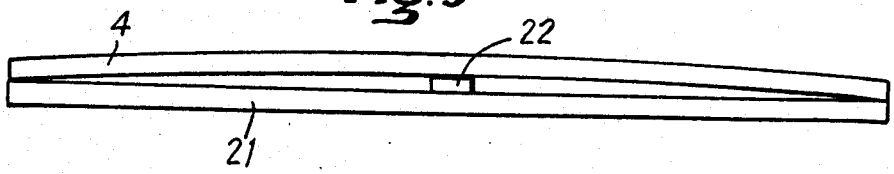
FIG. 5 is a vertical sectional view showing one embodiment of a curved panel.

For a more rapid flow of rain water, panels 4 may be slightly curved, as shown in FIG. 5, by fixing on their lower face, parallel to the width for example, one or more stiffening elements 21 (angle iron or channel) and spacers 22 of a few millimeters in thickness (of the order of 4 mm for example) so as to obtain on each panel 4 a slope directing the water from the center to the periphery, i.e. towards the ground.

It will be readily understood that the above description has been given solely by way of example and that constructional additions and modifications may be made without departing from the scope and spirit of the invention. In particular, it will be readily understood that the horizontal flanges 8 of connecting element 5 of FIGS. 1 and 2 could be turned outwardly which, if vertical flanges 7 are provided forming a slightly obtuse angle with the horizontal part 6, would allow elements 5 to be stacked for transport.

What I claim is:

1. An articulated modular athletic playing surface comprising:

(a) a plurality of flexible closely aligned horizontal panels of rectangular configuration;

(b) multiple plates of isolating material, each slightly smaller than its respective panel and having a lower surface bearing on the ground and an upper surface reslilently supporting the lower surface of its respective panel so as to maintain the proper height of the panels from the ground, give flexibility to the playing surface, and isolate the panels from the ground whereby differences in temperature and hygrometry between the lower and upper surfaces of the panels are reduced; and (c) a plurality of similar connecting element means, each having horizontal means and vertical means wherein some of the connecting means join the longitudinal edges of adjacent panels with the other connecting means joining the corners of adjacent panels, said some connecting means having the horizontal means fixed to the undersurfaces of the opposite longitudinal edges of two adjacent panels and said other connecting means having the horizontal means fixed to the undersurfaces of the corner of four adjacent panels, where the vertical means is of the same approximate height of said isolating plates so that the bottom of said vertical means bears on the ground.

2. A playing surface according to claim 1 having a rainwater drainage channel between adjacent panels extending through said connecting means.

3. A surface according to claim 1 in which the connecting means comprises a channel section having an upper horizontal element fixed to the underside of adjacent panels and a vertical flange on each side of said element.

4. A surface according to claim 3 in which the lower edge of each vertical flange includes a horizontal lip.

5. A surface according to claim 1 wherein said connecting means comprise right angle supports in which the horizontal arm is attached to the lower surface of a said panel and the vertical leg is attached to the leg of the right angle support of an adjacent panel.

6. A surface according to claim 1 wherein the panels have a chamber to drain rain water from the center over to the panel edge.

7. A surface according to claim 6 in which the chamber is maintained by a reinforcement element on the lower panel surface.

8. A surface according to claim 1 wherein a water permeable earth retaining fabric sheet is disposed between the connecting element means and the ground, preventing loose soil from washing up onto the surface and allowing water to drain down and away.

* * * * *